United States Patent [19]

O'Neil et al.

[11] Patent Number: 4,892,671

[45] Date of Patent: Jan. 9, 1990

[54] 2-PROPANOL DERIVATIVES AS CORROSION INHIBITORS

[75] Inventors: Robert M. O'Neil, Flixton; John D. Payne, Withington, both of England

[73] Assignee: Ciba-Geigy Corporation, Ardsley, N.Y.

[21] Appl. No.: 300,769

[22] Filed: Jan. 23, 1989

Related U.S. Application Data

[63] Continuation of Ser. No. 63,884, Jun. 19, 1987, abandoned.

[30] Foreign Application Priority Data

Jun. 28, 1986 [GB] United Kingdom ..... 8615866
Dec. 13, 1986 [GB] United Kingdom ..... 8629834

[51] Int. Cl.[4] ..... C10M 133/14; C07C 93/06

[52] U.S. Cl. ..... 252/51.5 R; 252/392; 564/347; 564/348; 564/349

[58] Field of Search ..... 564/347, 348, 349; 252/51.5 R, 392

[56] References Cited

U.S. PATENT DOCUMENTS

| | | | |
|---|---|---|---|
| 3,033,640 | 5/1962 | Hofer et al. | 8/603 |
| 3,043,774 | 7/1962 | Coffield | 252/51.5 R |
| 3,674,840 | 7/1972 | Grandstrom et al. | 564/347 |
| 3,930,016 | 12/1975 | Berntsson et al. | 564/348 |
| 4,024,083 | 5/1977 | Kablaoui et al. | 44/75 |
| 4,048,081 | 9/1977 | Machleder et al. | 252/51.5 R |
| 4,061,777 | 12/1977 | Mardiguian | 564/349 |
| 4,134,846 | 1/1979 | Machleder et al. | 44/58 |
| 4,147,641 | 4/1979 | Machleder et al. | 252/51.5 A |
| 4,259,086 | 3/1981 | Machleder et al. | 252/51.5 R |
| 4,311,708 | 1/1982 | Manoury et al. | 564/349 |
| 4,322,220 | 3/1982 | Machleder et al. | 252/51.5 R |
| 4,379,167 | 4/1983 | Lunsford et al. | 564/349 |
| 4,463,190 | 7/1984 | Lunsford et al. | 564/349 |
| 4,806,555 | 2/1989 | Lunsford et al. | 564/349 |

FOREIGN PATENT DOCUMENTS

| | | |
|---|---|---|
| 1439719 | 6/1976 | United Kingdom . |
| 1441976 | 7/1976 | United Kingdom . |

OTHER PUBLICATIONS

C.A., 91, 41654p (1979).
C.A., 94, 212779b.
C.A., 4304f of German 2,359,926.
C.A., 149472t (J. R. Conde et al., 455 (1977)).
C.A. of Spanish 412,963.
Chemical Abstracts Registry No. 3705-61-1.
Chemical Abstracts Registry No. 70670-84-7.
British Search Report.

*Primary Examiner*—William R. Dixon, Jr.
*Assistant Examiner*—Ellen M. McAvoy
*Attorney, Agent, or Firm*—Stephen V. O'Brien

[57] ABSTRACT

New composition comprises a functional fluid in contact with ferrous metal and a corrosion inhibiting amount of at least one compound of formula (I)

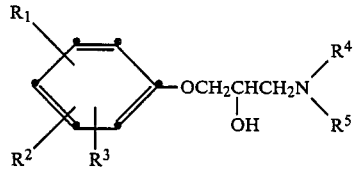

(I)

or a derivative thereof in which $R^1$, $R^2$ and $R^3$ are, independently, hydrogen, a $C_1$–$C_{15}$ straight or branched chain alkyl residue, a $C_5$–$C_{12}$ cycloalkyl residue, a $C_6$–$C_{15}$ aryl residue or $C_7$–$C_{12}$ alkaryl residue, and $R^4$ and $R^5$ are, independently, hydrogen, 2-hydroxyethyl or 2-hydroxypropyl with the provisos that (a) $R^4$ and $R^5$ are not simultaneously hydrogen,
(b) when $R^4$ and $R^5$ are each —$CH_2$—$CH_2$—OH, $R^1$ and $R^2$ are not simultaneously hydrogen and $R^3$ is not a pentyl residue and
(c) that polyalkylene and phenol or polycarboxylic ester co-additives are absent;

as well as salts thereof.

Some of the compounds of formula I are new.

11 Claims, No Drawings

2-PROPANOL DERIVATIVES AS CORROSION INHIBITORS

This application is a continuation, of application Ser. No. 063,884, filed June 19, 1987 abandoned.

The present invention relates to compounds useful as corrosion inhibitors for ferrous metals. More particularly, the invention relates to derivatives of propan-2-ol which have been found to possess excellent activity as corrosion inhibitors for ferrous metals in contact with functional fluids.

In the U.S. Pat. Nos. 4,134,846 and 4,147,641 multipurpose hydrocarbon fuel and lubricating oil additive mixtures comprising (a) reaction products of a glycidyl ether compound of the formula

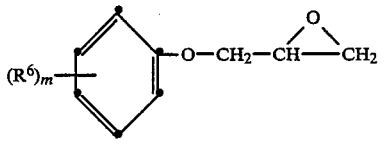

wherein $R^6$ is an alphabetic hydrocarbon group containing at least 8 carbon atoms and m is 1, 2 or 3 with a primary or secondary monoamine or polyamine; and (b) a polyalkylene phenol or a polycarboxylic acid ester respectively, are disclosed.

Further Mamedov et al. describe in Dokl. Akad. Nauk. Az. SSR 34(7), 1980, pp. 51–3 the compound

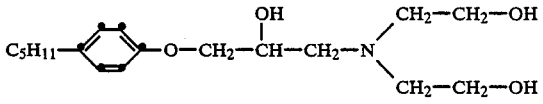

as biocide in lubricating oils.

According to the invention, there is provided a composition comprising a functional fluid in contact with ferrous metal and a corrosion inhibiting amount of at least one propan-2-ol derivative having the formula I:

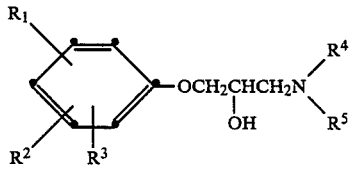

(I)

in which $R^1$, $R^2$ and $R^3$ are, independently, hydrogen, a $C_1$–$C_{15}$ straight or branched chain alkyl residue, a $C_5$–$C_{12}$ cycloalkyl residue, $C_6$–$C_{15}$ aryl residue or a $C_7$–$C_{12}$ aralkyl residue, and $R^4$ and $R^5$ are, independently, hydrogen, a 2-hydroxyethyl or 2-hydroxypropyl group, with the provisos that (a) $R^4$ $R^5$ are not simultaneously hydrogen each —$CH_2$—$CH_2$—OH, $R^1$ and $R^2$ are (b) when $R^4$ and $R^5$ are not simultaneously hydrogen and $R^3$ is not a pentyl residue and (c) that polyalkylene phenol or polycarboxylic ester co-additives are absent;

as well as salts thereof.

When one or more of $R^1$, $R^2$ and $R^3$ are a $C_1$–$C_{15}$ straight or branched chain alkyl residue, they may be methyl, ethyl, n-propyl, isopropyl, n-, iso- or tert.-butyl, n-, iso- or tert.pentyl, n-hexyl, n-heptyl, n-octyl, tert.-octyl, n- or isononyl, n- or isodecyl, n- or isoundecyl, n- or isododecyl, n- or iso-tridecyl, n- or iso-tetradecyl, n-pentadecyl or a mixture containing a major proportion of a alkyl residue derived from a naturally-occurring material e.g. a $C_{15}H_{31}$-x residue in which x is 0, 2, 4 or 6, derived from cashew nut oil or a $C_{15}H_{31}$ residue derived from hydrogenated cashew nut oil.

$C_5$–$C_{12}$ cycloalkyl residues $R^1$, $R^2$ and $R^3$ are principally cyclopentyl, cyclohexyl and cyclodecyl residues.

$C_6$–$C_{15}$ aryl residues $R^1$, $R^2$ and $R^3$ are chiefly phenyl or naphthyl residues, especially phenyl residues.

When one or more of $R^1$, $R^2$ and $R^3$ are $C_7$–$C_{12}$ aralkyl residues, they may be benzyl, α-methylbenzyl or α,α-dimethylbenzyl groups.

The salts are formed from the amine function of compounds of formula I using an inorganic acid, e.g. hydrochloric acid, sulfuric acid, sulphonic acid, phosphonic acid or boric acid or, preferably, an organic acid e.g. formic acid, acetic acid, propionic acid, gluconic acid, lauric acid, succinic acid, sebacic acid, maleic acid, citric acid, tartaric acid, oxalic acid, benzoic acid, phthalic acid or trimellitic acid.

The salts may be oil-soluble or water-soluble and are generally full or partial salts of mono-, di- or tri-acids. The salts may also be formed from partial esters of di- or tri-acids e.g. from methyl maleate or methyl succinate.

Most of the compounds of formula I are new but some compounds in which one or two of $R_1$, $R_2$ and $R_3$ are alkyl, have been disclosed. Thus, in U.S. Pat. No. 3,033,640, there are described compounds, useful for improving the dyeing properties of certain materials, and having the formula

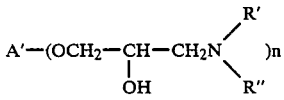

in which A′ is an aromatic radical which may be alkylated, e.g. lower alkylphenyl or di(lower alkyl) phenyl; n is 1 or 2; R′ is, inter alia, hydrogen or hydroxyalkyl; and R″ is, inter alia, hydrogen. However an example is disclosed therein, in which R′ and R″ both are hydroxyalkyl.

In Japanese Patent Application No. 79/37776 (80,130,359) a compound, useful in producing sand moulds, is described of formula

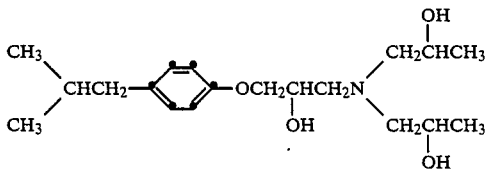

In DE-OS No. 2359926 pharmaceutically-active compounds are described having the formula e.g.

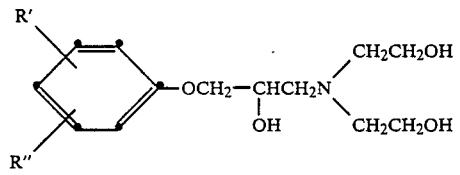

in which R′=H and R″=H or 2- or 3-$CH_3$; R′=2-$CH_3$, R″=3-i-$C_3H_7$; R′=3-$CH_3$, R″=2-i-$C_3H_7$; or R′=5-$CH_3$, R″=2-i-$C_3H_7$.

Conde et al., in Congr. Nac. Biofarm. Farmacocinet. [Actas] 1st 1977, 455–456 disclosed pharmacokinetic studies on the compound of formula

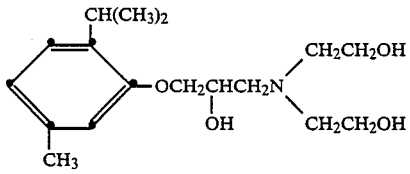

and the same author, in Spanish Patent No. 412963, describes the compound of formula:

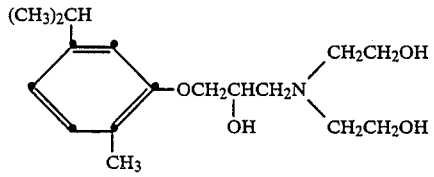

the GB Patent No. 1,439,719 discloses the compound

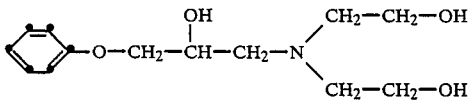

as a starting material for radiation curable synthetic resins.

Accordingly, the present invention also provides compounds having the formula I:

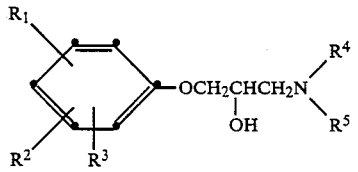

(I)

in which $R^1$, $R^2$, $R^3$, $R^4$ and $R^5$ have their previous significance provided that compounds are excluded in which:

(a) when one or more of $R^1$, $R^2$ and $R^3$ are $C_1$–$C_{15}$ alkyl, $R^4$ or $R^5$ is hydrogen;

(b) when $R^4$ and $R^5$ are each —$CH_2CH(OH)CH_3$, $R^1$ and $R^2$ are hydrogen and $R^3$ is hydrogen or 4-$CH_2CH(CH_3)_2$; and (c) when $R^4$ and $R^5$ are each —$CH_2CH_2OH$, $R^1$ is hydrogen, $R_2$ is hydrogen or methyl and $R_3$ is hydrogen or isopropyl;

(d) $R^1$, $R^2$ and $R^3$ are simultaneously hydrogen.

Preferred compounds of formula (I) are those in which $R^1$, $R^2$ or $R^3$ are independently a $C_3$–$C_{15}$ branched chain alkyl residue, especially propyl, butyl, amyl, octyl, nonyl or dodecyl.

Also preferred compounds of formula (I) are those in which $R_3$ is hydrogen and $R^1$ and $R^2$ are the same and are a $C_3$–$C_{15}$ branched chain alkyl residue and $R^4$ and $R^5$ have their previous significance.

Most preferred compounds of formula (I) are those in which $R^1$ and $R^2$ are hydrogen and $R^3$ is a $C_3$–$C_{15}$, especially a $C_9$ straight or branched chain alkyl residue positioned meta- or para- to the oxygen atom of the phenolic ring and P and P are 2-hydroxyethyl or 2-hydroxypropyl residues.

Additionally preferred compounds of formula (I) are those in which $R^1$, $R^2$ and $R^3$ are each i-$C_3H_7$.

The compounds of formula (I) may be produced by reacting a compound having the formula (II)

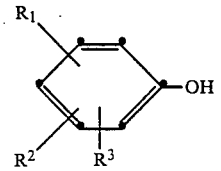

(II)

in which $R^1$, $R^2$ and $R^3$ have their previous significance, or a metal salt e.g. the sodium or potassium salt thereof, optionally in the presence of a catalyst e.g. an acid, a base, or a phase transfer catalyst, with a compound having the formula (III):

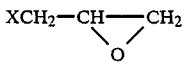

(III)

in which X is a chlorine or bromine atom, to produce a compound having the formula (IV):

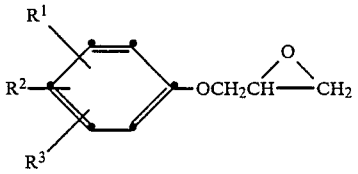

(IV)

which is then reacted with an amine $HNR^4R^5$ in which $R^4$ and $R^5$ have their previous significance, to produce compounds of formula (I).

Compounds of formula (II) which are particularly suitable as starting materials for the synthesis of compounds of formula (I) include:

2-methylphenol, 3-methylphenol, 4-methylphenol, 2-ethylphenol, 3-ethylphenol, 4-ethylphenol, 2-isopropylphenol, 3-isopropylphenol, 4-isopropylphenol, 2-secbutylphenol, 3-secbutylphenol, 4-secbutylphenol, 2-isobutylphenol, 3-isobutylphenol, 4-isobutylphenol, 2-tertbutylphenol, 3-tertbutylphenol, 4-tertbutylphenol, 2-tertamylphenol, 3-tertamylphenol, 4-tertamylphenol, 2-cyclohexylphenol, 3-cyclohexylphenol, 4-cyclohexylphenol, 2-tertoctylphenol, 3-tertoctylphenol, 4-tertoctylphenol, 2-nonylphenol, 3-nonylphenol, 4-nonylphenol, 2-dodecylphenol, 3-dodecylphenol, 3-pentadecylphenyl, $C_{15}$-pentadecylphenol containing phenolic mixture derived from cashew nut oil, 4-dodecylphenol, 2-phenylphenol, 3-phenylphenol, 4-phenylphenol, 2-cumylphenol, 3-cumylphenol, 4-cumylphenol, 2,4-dimethylphenol, 2,5-dimethylphenol, 2,6-dimethylphenol, 3,5-dimethylphenol, 2,4-diethylphenol, 2,5-diethylphenol, 2,6-diethylphenol, 3,5-diethylphenol, 2,4-diisopropylphenol, 2,5-diisopropylphenol, 2,6-diisopropylphenol, 3,5-diisopropylphenol, 2,4-di-secbutylphenol, 2,5-di-secbutylphenol, 2,6-di-secbutylphenol, 3,5-di-secbutylphenol, 2,4-di-tertbutylphenol, 2,5-di-tertbutylphenol, 2,6-di-tertbutylphenol, 3,5-di-tertbutylphenol, 2,4-di-tertamylphenol, 2,5-di-tertamylphenol, 2,6-di-tertamylphenol, 3,5-di-tertamylphenol, 2,4-dicyclohexylphenol, 2,5-dicyclohexylphenol, 2,6-dicyclohexylphenol, 3,5-dicyclohexylphenol, 2,4-dinonylphenol, 2,4,6-triisopropylphenol.

Many of the above substituted phenolic starting materials are not always easily obtained in an isometrically pure state.

In order to synthesize compounds of formula (I), the use of such mixtures of isomers is implied in cases where it is appropriate. For example, commercially available p-nonylphenol is assumed to be comprised of a mixture of several $C_9$-branched chain alkyl residues, and may in addition, contain small and varying amounts of the ortho-and meta-isomers.

Compounds of formula (I) wherein $R^4$ and $R^5$ are the same and are 2-hydroxyethyl or 2-hydroxypropyl are conveniently prepared by the dropwise addition of an epoxide of formula (IV) to an equimolar quantity of diethanolamine or diisopropanolamine, the preferred reaction temperature being in the region 70°-90° C. The products thus obtained are sufficiently pure and require no purification.

Compounds of formula (I) wherein $R^4$ is hydrogen and $R^5$ is 2-hydroxyethyl or 2-hydroxypropyl, are conveniently prepared by the dropwise addition of an epoxide of formula (IV) to a molar excess, preferably about five-fold, of ethanolamine or isopropanolamine, the preferred reaction temperature being in the region 70°-90° C. The products thus obtained are preferably isolated by fractional distillation of the reaction mixture.

The compounds of formula (I) are active in imparting desirable properties, especially corrosion-inhibiting properties to functional fluids. The said compounds are effective as corrosion inhibitors in functional fluids in amounts of 0.01-5 wt. %, especially 0.02-1 wt. % based on the functional fluid. Preferably, the functional fluid is a non-aqueous functional fluid.

Non-aqueous functional fluids may be a lubricating oil e.g. a natural or synthetic lubricating oil; a refined petroleum product such as a fuel oil, diesel, oil, kerosene, gasoline or aviation fuel; or a hydraulic fluid e.g. a phosphate-based synthetic oil.

The lubricating oil may be a mineral oil, a synthetic oil or any mixture of such oils. Mineral oils especially steam turbine oils are preferred and examples of these include parffinic hydrocarbon oils e.g. a mineral oil having a viscosity of 46 $mm^2/s$ at 40° C, −150 Solvent Neutral" a solvent refined neutral mineral oil having a viscosity of 32 $mm^2/s$ at 40° C. and "Solvent brightstocks", a high-boiling residue from the process of refining mineral oil, and having a viscosity of 46 $mm^2/s$ at 40° C.

Synthetic lubricating oils which may be present may be synthetic hydrocarbons such as polybutenes, alkylbenzenes and poly-alpha olefins as well as simple di-, tri- and tetra-esters, complex esters and polyesters derived from carboxylic acid esters of formula:

$$R^6\text{—OOC—alkylene—COOR}^7$$

wherein "alkylene" denotes an alkylene residue having from 2 to 14 carbon atoms and $R^6$ and $R^7$ are the same or different and each is an alkyl group having from 6 to 18 carbon atoms.

Tri-esters which are of use as lubricating oil basestocks are those derived from trimethylolpropane and $C_6$-$C_{18}$ monocarboxylic acids or mixtures thereof, whereas suitable tetraesters include those derived from pentaerythritol and a $C_6$-$C_{18}$ monocarboxylic acid or mixtures thereof.

Complex esters suitable for use as components of the compositions of the present invention are those derived from monobasic acids, dibasic acids and polyhydric alcohols, for instance the complex ester derived from trimethylol, propane, caprylic acid and sebacic acid.

Suitable polyesters are those derived from an aliphatic dicarboxylic acid having from 4 to 14 carbon atoms and at least one aliphatic dihydric alcohol having from 3 to 12 carbon atoms, e.g. those derived from azelaic acid or sebacic acid and 2,2,4,-trimethylhexane-1,6-diol.

The lubricating oil applicational media can also contain other additives which may be added to improve the basic properties of lubricants e.g. antioxidants, metal passivators, rust inhibitors, viscosity-index improvers, pour point depressants, dispersing agents, detergents, extreme pressure additives and anti-wear additives.

EXAMPLES OF PHENOLIC ANTIOXIDANTS

1. Alkylated Monophenols 2,6-Di-tert.-butylphenol
2-tert.-Butyl-4,6-dimethylphenol
2,6-Di-tert.-butyl-4-ethylphenol
2,6-Di-tert.-butyl-4-n-butylphenol
2,6-Di-tert.-butyl-4-i-butylphenol
2,6-Di-cyclcopentyl-4-methylphenol
2-(β-Methylcyclohexyl)-4,6-dimethylphenol
2,6-Di-octadecyl-4-methylphenol
2,4,6-Tri-cyclohexylphenol
2,6-Di-tert.butyl-4-methoxymethylphenol

2. Alkylated Hydroquinones 2,6-Di-tert.-butyl-4-methoxyphenol
2,5-Di-tert.-butyl-hydroquinone
2,5-Di-tert.-amyl-hydroquinone
2,6-Diphenyl-4-octadecyloxyphenol

3. Hydroxylated Thiodiphenylethers 2,2'-Thio-bis-(6-tert.butyl-4-methylphenol)
2,2'-Thio-bis-(4-octylphenol)
4,4'-Thio-bis-(6-tert.butyl-3-methylphenol)
4,4'-Thio-bis-(6-tert.butyl-2-methylphenol)

4. Alkylidene-Bisphenols 2,2'-Methylene-bis-(6-tert.butyl-4-methylphenol)
2,2'-Methylene-bis-(6-tert.butyl-4-ethylphenol)
2,2'-Methylene-bis-(4-methyl-6-(α-methylcyclohexyl)-phenol)
2,2'-Methylene-bis-(4-methyl-6-cyclohexylphenol
2,2'-Methylene-bis-(6-nonyl-4-methylphenol)
2,2'-Methylene-bis-(4,6-di-tert.-butylphenol)
2,2'-Ethylidene-bis-(4,6-di-tert.-butylphenol)

2,2'-Ethylidene-bis-(6-tert.-butyl-5-isobutylphenol)
2,2'-Methylene-bis-(6-(α-methylbenzyl-4-nonylphenol)
2,2'-Methylene-bis-(6-(α,α-dimethylbenzyl)-4-nonylphenol)
4,4'-Methylene-bis-(6-tert.-butyl-2-methylphenol)
1,1'-Bis-(5-tert.-butyl-4-hydroxy-2-methylphenol)-butane
2,6-Di-(3-tert.butyl-5-methyl-2-hydroxybenzyl)-4-methylphenol
1,1,3-Tris-(5-tert.butyl-4-hydroxy-2-methylphenyl)-3-n-dodecyl)mercaptobutane
Ethyleneglycol-bis-[3,3-bis-(3'-tert.-butyl-4'-hydroxyphenyl)butyrate]
Di-(3-tert.-butyl-4-hydroxy-5-methylphenyl)-dicyclopentadiene
Di-[3'-tert.-butyl-2'-hydroxy-5'-methyl-benzyl)-6-tert.-butyl-4-methyl-phenyl]-terephthalate 5. Benzyl Compounds 1,3,5-Tri-(3,5-di-tert.-butyl-4-hydroxybenzyl),2,4,6-trimethylbenzene
Di-(3,5-di-tert.-butyl-4-hydroxybenzyl)-sulfide
Bis-(4-tert.-butyl-3-hydroxy-2,6-dimethylbenzyl)dithiolterephthalate
1,3,5-Tris-(3,5-di-tert.-butyl-4-hydroxybenzyl)-isocyanate
1,3,5-Tris-(4-tert,-butyl-3-hydroxy-2,6-dimethylbenzyl)-isocyanurate
3,5-Di-tert.butyl-4-hydroxybenzyl-phosphonic acid-dioctadecylester
3,5-Di-tert.butyl-4-hydroxybenzyl-phosphonic acid-monoethylester
Calcium-salt 6. Acylaminophenols 4-Hydroxy-lauric acid anilide
4-Hydroxy-stearic acid anilide
2,4-Bis-octylmercapto-6-(3,5-di-tert.-butyl-4-hydroxyanilino)-s-triazine
N-(3,5-di-tert.-butyl-4-hydroxyphenyl)-carbamic acid octyl ester 7. Esters of
β-(3,5-Di-tert.-butyl-4-hydroxyphenol)-propionic acid with mono- or polyhydric alcohols e.g., with
Methanol—Diethyleneglycol
Octadecanol—Triethyleneglycol
1,6-Hexandiol—Pentaerythritol
Neopentylglycol—Tris-hydroxyethyl-isocyanurate
Thiodiethyleneglycol—Di-hydroxyethyl-oxalic acid diamide 8. Esters of
β-(5-tert.-butyl-4-hydroxy-3-methylphenyl-propionic acid with mono- or polyhydric alcohols eg with
Methanol—Diethyleneglycol
Octadecanol—Triethyleneglycol
1,6-Hexandiol—Pentaerythritol
Neopentylglycol—Tris-hydroxyethyl-isocyanurate
Thiodiethyleneglycol—Di-hydroxyethyl-oxalic acid diamide 9 Amides of
β-(3,5-Di-tert.butyl-4-hydroxyphenyl)-propionic acid e.g.

N,N'-Di-(3,5-di-tert.-butyl-4-hydroxyphenylpropionyl)-hexamethylenediamine
N,N'-Di-(3,5-di-tert.-butyl-4-hydroxyphenylpropionyl)-trimethylenediamine
N,N'-Di-(3,5-di-tert.-butyl-4-hydroxyphenylpropionyl)-hydrazine

EXAMPLES OF AMINE ANTIOXIDANTS

N,N'-Di-isopropyl-p-phenlenediamine
N,N'-Di-sec.-butyl-p-phenylenediamine
N,N'-Bis(1,4-dimethyl-pentyl)-p-phenylenediamine
N,N'-Bis(1-ethyl-3-methyl-pentyl)-p-phenylenedimine
N,N'-Bis(1-methyl-heptyl)-p-phenylenediamine
N,N'-Dicyclohexyl-p-phenylenediamine
N,N'-Diphenyl-p-phenylenediamine
N,N'-Di-(naphthyl-2-)-p-phenylenediamine
N-Isopropyl-N'-phenyl-p-phenylenediamine
N-(1,3-Dimethyl-butyl)-N'-phenyl-p-phenylenediamine
N-(1-Methyl-heptyl)-N'-phenyl-p-phenylenediamine
N-Cyclohexyl-N'-phenyl-p-phenylenediamine
4-(p-Toluene-sulfonamido)-diphenylamine
N,N'-Dimethyl-N,N'-di-sec.-butyl-p-phenylenediamine
Diphenylamine
4-Isopropoxy-diphenylamine
N-Phenyl-1-naphthylamine
N-Phenyl-2-naphthylamine
octylated Diphenylamine
octylated N-phenyl- (or) naphthylamine
4-n-Butylaminophenol
4-Butyrylamino-phenol
4-Nonanoylamino-phenol
4-Iodecanoylamino-phenol
4-Octadecanoylamino-phenol
Di-(4-methoxy-phenyl)-amine
2,6-Di-tert.-butyl-4-dimethylamino-methyl-phenol
2,4'-Diamino-diphenylmethane
4,4'-Diamino-diphenylmethane
N,N,N',N'-Tetramethyl-4,4'-diamino-diphenylmethane
1,2-Di-(phenylamino)-ethane
1,2-Di-[2-methyl-phenyl)-amino]-ethane
1,3-Di-(phenylamino)-propane
(o-tolyl)-biguanide
Di-[4-(1 ', 3'-dimethyl-butyl)-phenyl]amine.

Examples of metal passivators are, for copper, benzotriazole, tetrahydrobenzotriazole, tolutriazole, 2-mercapto-benzothiazole, 2,5-dimercaptothiadiazole, salicylidine-propylenediamine salts of salicylaminoguanidine and N,N-disubstituted aminomethyl triazoles of formula

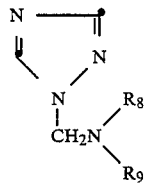

in which $R_8$ and $R_8$ are, independently, e.g. alkyl, alkenyl, or hydroxyethyl, obtained by reacting 1,2,4-triazole with formaldehyde and an amine $HNR_8R_8$, as disclosed in European Patent Application No. 160620 and the Mannich reaction products derived from benzotriazole or tolutriazole, formaldehyde and an amine HNRsRs.

Examples of further rust inhibitors are:

(a) organic acids, their esters, metal salts and anhydrides e.g. N-oleoyl sarcosine, sorbitan-mono-oleate, lead naphthenate, dodecenyl succinic anhydride, alkenyl-succinic acid partial esters, e.g. product sold under trade name Lubrizol 859, (Lubrizol Corp. U.S.A) alkenyl-succinic acid partial imides e.g. Hitec 536 (which is a trade name of Ethyl Corp. U.S.A.) and 4-nonylphenoxy-acetic acid;

(b) nitrogen-containing compounds e.g.

I primary-, secondary- tertiary aliphatic- or cycloaliphatic amines and amine salts of organic and inorganic acids e.g. oil-soluble alkylammonium carboxylates; and II Heterocyclic compounds e.g. substituted imidazolidines and oxazolidines;

(c) phosphorus-containing compounds e.g. amine salts of phosphoric acid and phosphonic acid partial esters;

(d) sulphur-containing compounds e.g. barium-dinonyl naphthalene sulphonates and calcium petroleum sulphonates.

(e) derivatives of gamma-alkoxypropylamines described in Japanese Patent Publication No. 15783/1973; and (f) salts having the formula $Y—NH_3.R^{10}CO_2—$ in which Y is a group $R^{11}X^1CH_2CH(OH)CH_2$ in which $R^{10}$ and $R^{11}$, independently, are e.g. alkyl and $X^1$ is O, $CO^2$, NH, N(alkyl), N(alkenyl) or S, these salts being prepared by mixing an amine $Y\text{-}NH^2$ with an acid $R^{10}CO_2H$, as disclosed in British Patent Application No. 2148294.

Examples of viscosity-index improvers are;

Polymethacrylates, vinylpyrrolidone/methacrylate copolymers, polybutenes, olefin-copolymers, styrene/acrylate copolymers.

Examples of pour-point depressants are:

Polymethacrylates and alkylated naphthalene derivatives.

Examples of dispersing agents/surfactants are

Polybutenyl succinic acid imides, polybutenylphosphonic acid derivatives, and basic Mg-, Ca- and Ba sulphonates and -phenolates.

Examples of extreme pressure agents/anti-wear additives are:

Compounds containing sulphur and/or phosphorus and/or halogen e.g. sulphurised vegetable oils, zinc dialkyl dithiophosphates, tritolyl phosphate, chlorinated paraffins and alkyl- and aryl disulphides.

In a less preferred embodiment, the functional fluid may be partly aqueous e.g. an aqueous machining fluid formulation, e.g. a water dilutable cutting or grinding fluid, or an industrial cleaning fluid.

The aqueous machining fluid formulations treated according to the invention may be e.g. metal working formulations. By "metal working" we mean reaming, broaching, drawing, spinning, cutting, grinding, boring, milling, turning, sawing, non-cutting shaping, rolling or quenching. Examples of water-dilutable cutting or grinding fluids into which the corrosion inhibiting compound may be incorporated include:

(a) Aqueous concentrates of one or more corrosion inhibitors, and optionally one or more anti-wear additives which are usually employed as grinding fluids;

(b) Polyglycols containing biocides, corrosion inhibitors and anti-wear additives for cutting operations or grinding;

(c) Semi-synthetic cutting fluids similar to (b) but containing in addition 10 to 25% oil with sufficient emulsifier to render the water diluted product translucent;

(d) An emulsifiable mineral oil concentrate containing, for example, emulsifiers, corrosion inhibitors, extreme pressure/anti-wear additives, biocides, antifoaming agents, coupling agents etc; they are generally diluted with water to a white opaque emulsion;

(e) A product similar to (d) containing less oil and more emulsifier which on dilution gives a translucent emulsion for cutting or grinding operations.

For those partly-aqueous systems in which the functional fluid is an aqueous machining fluid formulation the inhibitor component (B) may be used singly, or in admixture with other additives e.g. known further corrosion inhibitors or extreme-pressure additives.

Examples of other corrosion inhibitors which may be used in these aqueous systems, in addition to the compound of formula I used according to the invention, include the following groups:

Organic acids, their esters or ammonium, amine, alkanolamine and metal salts, for example, benzoic acid, p-tert-butyl benzoic acid, disodium sebacate, triethanolamine laurate, iso-nonanoic acid, triethanolamine salt of p-toluene sulphonamido caproic acid triethanolamine salt of benzene sulphonamide caproic acid, triethanolamine salts of 5-ketocarboxylic acid derivatives as described in European Patent No. 41927, sodium N-lauroyl sacrosinate or nonyl phenoxy acetic acid;

(b) Nitrogen containing materials such as the following types: fatty acid alkanolamides; imidazolines, for example, 1-hydroxyethyl-2-oleyl-imidazolines; oxazolines; triazoles for example, benzotriazoles; or their Mannich base derivatives; triethanolamines; fatty amines, inorganic salts, for example, sodium nitrate; and the carboxy-triazine compounds described in European Patent Application No. 46139;

(c) Phosphorus containing materials such as the following types: amine phosphates, phosphonic acids or inorganic salts, for example, sodium dihydrogen phosphate or zinc phosphate;

(d) Sulphur containing compounds such as the following types: sodium, calcium or barium petroleum sulphonates, or heterocyclics, for example, sodium mercaptobenzothiazole. Nitrogen containing materials, particularly triethanolamine, are preferred.

When incorporated into a partially aqueous functional fluid the compound of formula I is preferably in the form of a water-soluble drivative e.g. a salt formed with an organic acid e.g. a $C_6$–$C_{20}$ carboxylic acid, such as lauric acid, or an inorganic acid e.g. hydrochloric acid, sulphuric acid or boric acid.

The functional fluid may be a substantially aqueous system e.g. a water-based cutting fluid, a water-based surface coating e.g. a dispersion paint, an emulsion paint or electrodepositable paint; or a totally aqueous system such as a cooling water system, an air conditioning system, a steam generating system, a sea water evaporator system, a hydrostatic cooker, or a closed circuit heating or refrigerant system.

The compounds of formula I are particularly useful as additives to lubricating systems, especially turbine and engine oils, in which they exhibit corrosion-inhibiting properties.

The following Examples further illustrate the present invention. All parts and percentages given are by weight.

Example 1

276 parts p-nonylphenylglycidyl ether are added dropwise to 105 diethanolamine, with stirring, at 80° C. After complete addition, the reaction temperature is maintained at 80° C. for a further hour. The product 1-[N,N-bis(2-hydroxyethyl)amino]-3-(4-nonylphenoxy)propan-2-ol obtained quantitatively, is a colurless, viscous oil and requires no purification. $^1$H nmr ($CDCl_3$); δ7.2–6.5 (m,4H); 4.6 (s,3H); 4.1–3.2 (m,7H); 3.0–2.1 (m,6H); 2.0–0.3 (m,19H).

EXAMPLE 2

Using the procedure described in Example 1, 206 parts p-tert-butylphenylglycidyl ether are reacted with 105 parts of diethanolamine to yield 1-[N,N-bis(2-hydroxyethyl)amino]-3-(4-tert-butylphenoxy)propan-2-ol as a colorless, viscous oil, which solidifies upon cooling to yield a white solid, mp=45°–7° C. $^1$H nmr ($CDCl_3$); δ7.4–6.6 (m,4H); 4.9 (s,3H); 4.3–3.3 (m,7H); 3.1–2.2 (m,6H); 1.3 (s,9H).

EXAMPLE 3

Using the procedure described in Example 1, 234 parts of 2,4-diisopropylphenylglycidyl ether are reacted with 133 parts diisopropanolamine to yield 1-[N,N-bis(2-hydroxypropyl)amino]-3-((2,4-diisopropylphenoxy)propan-2-ol as a colorless, viscous oil. $^1$H nmr ($CDCl_3$); 7.0–6.5 (m,3H); 4.8 (s,3H); 4.2–2.0 (m,13H); 1.5–0.9 (m,18H).

EXAMPLE 4

101 parts of 4-tert-octylphenylglycidyl ether were added dropwise to 122 parts ethanolamine at 80°–85° C. with stirring. After complete addition, the reaction mixture was maintained at 80°–85° C. for a further hour. Excess ethanolamine was removed by distillation of the reaction mixture at 33.25 mbar pressure. The residual oil was then distilled under high vacuum to yield 100 parts of 1-(N-2-hydroxyethyl)-3-(4-tert-octylphenoxy)-propan-2-ol as a colurless, viscous oil, bp 230° C./0.93 mbar which solidified upon standing to a white solid, mp 64°–6° C.

$^1$H nmr ($CDCl_3$); δ7.0 (d,2H); 6.6 (d,2H); 4.3–3.4 (m,8H); 3.0–2.4 (m,4H); 1.6 (s,2H); 1.3 (s,6H); 0.7 (s,9H).

Compounds having the formula:

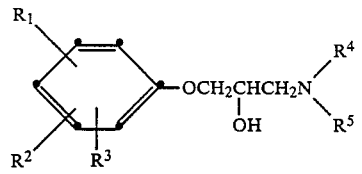

in which $R^1$, $R^2$, $R^3$, $R^4$ and $R^5$ have their previous significance are prepared in a similar manner and are shown in Table 1.

TABLE 1

| Example | $R^1$ | $R^2$ | $R^3$ | $R^4$ | $R^5$ | mp or bp |
|---|---|---|---|---|---|---|
| 5 | H | H | 4-$^{sec}C_4H_9$ | H | $CH_2CH_2OH$ | 210°/0.52 mbar |
| 6 | H | H | 4-$^{sec}C_4H_9$ | H | $CH_2CH(OH)CH_3$ | 65–8° C. |
| 7 | H | H | 4-$^{sec}C_4H_9$ | $CH_2CH_2OH$ | $CH_2CH_2OH$ | viscous oil |
| 8 | H | H | 4-$^{sec}C_4H_9$ | $CH_2CH(OH)CH_3$ | $CH_2CH(OH)CH_3$ | viscous oil |
| 9 | H | H | 4-$^{tert}C_4H_9$ | H | $CH_2CH_2OH$ | 75–6° C. |
| 10 | H | H | 4-$^{tert}C_4H_9$ | H | $CH_2CH(OH)CH_3$ | 97–100° C. |
| 11 | H | H | 4-$^{tert}C_4H_9$ | $CH_2CH(OH)CH_3$ | $CH_2CH(OH)CH_3$ | viscous oil |
| 12 | H | H | 4-$^{tert}C_8H_{17}$ | H | $CH_2CH(OH)CH_3$ | 230°/0.91 mbar |
| 13 | H | H | 4-$^{tert}C_8H_{17}$ | $CH_2CH_2OH$ | $CH_2CH_2OH$ | 42–3° C. |
| 14 | H | H | 4-$^{tert}C_8H_{17}$ | $CH_2CH(OH)CH_3$ | $CH_2CH(OH)CH_3$ | viscous oil |
| 15 | H | H | 4-$^{i}C_9H_{19}$ | H | $CH_2CH_2OH$ | 240°/0.65 mbar |
| 16 | H | H | 4-$^{i}C_9H_{19}$ | H | $CH_2CH(OH)CH_3$ | 230°/0.52 mbar |
| 17 | H | H | 4-$^{i}C_9H_{19}$ | $CH_2CH(OH)CH_3$ | $CH_2CH(OH)CH_3$ | viscous oil |
| 18 | H | H | 4-Ph-$C(CH_3)_2$ | $CH_2CH_2OH$ | $CH_2CH_2OH$ | viscous oil |
| 19 | H | H | 4-Ph-$C(CH_3)_2$ | $CH_2CH(OH)CH_3$ | $CH_2CH(OH)CH_3$ | viscous oil |
| 20 | H | H | 4-Ph | $CH_2CH_2OH$ | $CH_2CH_2OH$ | waxy solid |
| 21 | H | H | H | $CH_2CH(OH)CH_3$ | $CH_2CH(OH)CH_3$ | viscous oil |
| 22 | 2-$^{i}C_3H_7$ | H | 4-$^{i}C_3H_7$ | $CH_2CH_2OH$ | $CH_2CH_2OH$ | viscous oil |
| 23 | 2-$^{i}C_3H_7$ | 4-$^{i}C_3H$ | 6-$^{i}C_3H_7$ | $CH_2CH_2OH$ | $CH_2CH_2OH$ | 93–4° C. |
| 24 | H | H | 4-$^{i}C_{12}H_{25}$ | $CH_2CH_2OH$ | $CH_2CH_2OH$ | viscous oil |
| 25 | H | H | 4-$^{i}C_{12}H_{25}$ | H | $CH_2CH_2OH$ | 235°/0.52 mbar |
| 26 | H | 2-$^{tert}C_4H_9$ | 4-$^{tert}C_4H_9$ | $CH_2CH_2OH$ | $CH_2CH_2OH$ | 230°/0.91 mbar |
| 27 | H | H | 3-$C_{15}H_{31}$-x in which x is 0, 2, 4 or 6 | $CH_2CH_2OH$ | $CH_2CH_2OH$ | viscous oil |
| 28 | H | H | 3-$C_{15}H_{31}$ | $CH_2CH_2OH$ | $CH_2CH_2OH$ | viscous oil |
| 29 | H | H | 2-cyclo$C_6H_{11}$ | $CH_2CH_2OH$ | $CH_2CH_2OH$ | viscous oil |

EXAMPLES 30 to 39

Several products of formula (I) were tested as rust inhibitors in a turbine grade mineral oil of viscosity 3 1.6 mm 2/ s at 40° C., 4.6 $mm^2/s$ at 100° C. and a typical sulphur content of 0.6 %, using the ASTM D665B method. A pass in this test represents no traces of rusting of the test spindle. The absence of additive causes severe rusting of the test spindle to occur. The results are illustrated in Table 2.

TABLE 2

| Example | Product of Example | Concentration | D665B test |
|---|---|---|---|
| 30 | 1 | 0.05% | Pass |
| 31 | 4 | 0.05% | Pass |
| 32 | 13 | 0.05% | Pass |
| 33 | 15 | 0.05% | Pass |
| 34 | 24 | 0.05% | Pass |
| 35 | 25 | 0.55% | Pass |
| 36 | 26 | 0.05% | Pass |
| 37 | 27 | 0.05% | Pass |
| 38 | 28 | 0.05% | Pass |
| 39 | 29 | 0.05% | Pass |

What we claim is:

1. A composition consisting essentially of a lubricant in contact with ferrous metal and a corrosion inhibiting amount of at least one compound of formula (I).

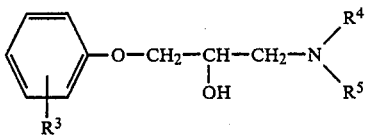

(I)

or a derivative thereof in which $R^3$ is hydrogen, a $C_3$–$C_{15}$ straight or branched chain alkyl residue, a $C_5$–$C_{12}$ cycloalkyl residue, a $C_6$–$C_{15}$ aryl residue or $C_7$–$C_{12}$ aralkyl residue, and $R^4$ and $R^5$ are, independently, hydrogen, 2-hydroxyethyl or 2-hydroxypropyl with the provisos that (a) $R^4$ and $R^5$ are not simultaneously hydrogen;

(b) when $R^4$ and $R^5$ are each —$CH_2$—$CH_2$—OH, $R^3$ is not a pentyl residue;

(c) that polyalkylene phenol or polycarboxylic ester co-additives are absent; and (d) when $R^3$ is $C_3$–$C_{15}$ alkyl, $R^4$ and $R^5$ are not hydrogen; as well as salts thereof.

2. A composition according to claim 1 wherein the amount of compound of formula (I) present ranges from 0.01–5 weight % based on the weight of the lubricant.

3. A composition according to claim 1 wherein the lubricating oil is a mineral oil.

4. A composition according to claim 3 wherein the mineral oil is a steam turbine oil.

5. A composition according to claim 1 wherein the lubricating oil also contains one or more of an antioxidant, a metal deactivator, rust inhibitor, viscosity index improver, pour point depressant, dispersing agent, detergent, an extreme-pressure and an anti-wear additive.

6. A process for the inhibition of the corrosion of ferrous metals due to contact with lubricant which comprises incorporating into the lubricant an effective corrosion inhibiting amount of a compound of Formula I according to claim 1.

7. A compound of formula (I)

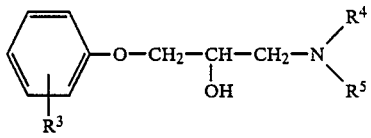

(I)

or a derivative thereof in which $R^3$ is a $C_3$–$C_{15}$ straight or branched chain alkyl residue, a $C_5$–$C_{12}$ cycloalkyl residue, a $C_6$–$C_{15}$ aryl residue or $C_7$–$C_{12}$ aralkyl residue, and $R^4$ and $R^5$ are, independently, hydrogen, 2-hydroxyethyl or 2-hydroxypropyl with the provisos that (a) $R^4$ and R5 are not simultaneously hydrogen, (b) when $R^4$ and $R^5$ are each —$CH_2$—$CH_2$—OH, $R^3$ is not hydrogen or isopropyl;

(c) when $R^4$ and $R^5$ are each —$CH_2CH(OH)CH_3$, $R^3$ is not hydrogen or 4-isobutyl;

(d) when $R^3$ is $C_3$–$C_{15}$ alkyl, $R^4$ and $R^5$ are not hydrogen.

8. A compound of formula (I) as defined in claim 7 wherein $R^3$ is a $C_3$–$C_{15}$ branched chain alkyl residue.

9. A compound according to claim 7 wherein $R^3$ is a $C_3$–$C_{15}$ straight or branched chain alkyl residue in meta- or para-position to the oxygen atom of the phenolic ring and $R^4$ and $R^5$ are 2-hydroxyethyl or 2-hydroxypropyl residues.

10. A compound of formula (I) as defined in claim 9 in which $R^3$ is a $C_9$ straight or branched chain alkkyl residue.

11. A compound according to claim 8 in which the $C_3$–$C_{15}$ branched chain alkyl residue $R^3$ is propyl, butyl, amyl, octyl, nonyl or dodecyl.

* * * * *